US007345566B2

(12) United States Patent
Urano

(10) Patent No.: US 7,345,566 B2
(45) Date of Patent: Mar. 18, 2008

(54) MAGNETIC ELEMENT

(75) Inventor: Yuichiro Urano, Sumida-ku (JP)

(73) Assignee: Sumida Corporation (JP)

( * ) Notice: Subject to any disclaimer, the term of this patent is extended or adjusted under 35 U.S.C. 154(b) by 52 days.

(21) Appl. No.: 11/192,726

(22) Filed: Jul. 28, 2005

(65) Prior Publication Data

US 2006/0028302 A1 Feb. 9, 2006

(30) Foreign Application Priority Data

Aug. 5, 2004 (JP) ..... 2004-229161

(51) Int. Cl.
*H01F 27/24* (2006.01)

(52) U.S. Cl. ..... 336/212; 336/180; 336/182

(58) Field of Classification Search ..... 336/212, 336/180, 182, 208
See application file for complete search history.

(56) References Cited

U.S. PATENT DOCUMENTS 6,483,412 B1 * 11/2002 Holdahl et al. ..... 336/192
6,501,362 B1 * 12/2002 Hoffman et al. ..... 336/198
6,927,667 B1 * 8/2005 Busletta et al. ..... 336/208
6,967,553 B2 * 11/2005 Jitaru ..... 336/178

FOREIGN PATENT DOCUMENTS

JP 2003-031422 1/2003

* cited by examiner

*Primary Examiner*—Anh Mai
(74) *Attorney, Agent, or Firm*—Von Simson & Chin LLP; Stephen Chin

(57) ABSTRACT

A magnetic element capable of obtaining a desired characteristic and at the same time having high productivity that enables cost reduction is provided. The magnetic element includes a first coil (50) to which a signal is inputted, a second coil (60) to which the signal inputted to the first coil (50) is transmitted, and includes a first core (20) having a first columnar leg portion (26) on which the first coil (50) is wound and a first peripheral wall portion (22, 23, 24) arranged on the periphery of the first columnar leg portion (26), and a second core (30) having a second columnar leg portion (36) on which the second coil (60) is wound and a second peripheral wall portion (32, 33 34) arranged on the periphery of the second columnar leg portion (36). The relative permeability of the first core (20) is set higher than the relative permeability of the second core (30), the first columnar leg portion (26) and the second columnar leg portion (36) abut on each other, and the first peripheral wall portion (22, 23, 24) and the second peripheral wall portion (32, 33, 34) abut on each other.

9 Claims, 8 Drawing Sheets

MAGNETIC ELEMENT

BACKGROUND OF THE INVENTION

1. Field of the Invention

The present invention relates to a magnetic element such as a transformer used as a band pass filter for example.

2. Description of the Related Art

Among transformers which are kinds of magnetic elements, there is a type that functions as a so-called band pass filter (band filter), which only passes signals in a desired frequency band (for example, in the vicinity of 13 kHz). In this type of transformer, it is required to set an impedance to a desired value and have a characteristic such that among signals inputted to a primary side, a high frequency signal equal to or higher than a predetermined frequency and a low frequency signal equal to or lower than a predetermined frequency are attenuated on a secondary side.

Incidentally, the impedance is in proportion to an inductance, and at a high frequency, an alternating current is difficult to flow, so that an attenuation effect of high frequency signals can be obtained. Accordingly, when the above-described characteristic is to be obtained in a transformer, in the current situation, a structure using two cores each formed of a material having a high relative permeability (μ) of 10000 or higher is adopted. Note that in the following description, these two cores are referred to as a first core and a second core, respectively.

Here, the first core and the second core are arranged opposite to each other, and on a magnetic path formed between the first core and the second core, there is provided a gap (also referred to as an air gap) that is an empty space in which no magnetic material exists. Existence of such a gap enables attenuation of signals on the low frequency side.

Generally, this gap is provided, for example in an EP-type core, between a columnar leg portion of the first core and a columnar leg portion of the second core. It has been found that the smaller (narrower) this gap is, the better the obtained characteristic is, and thus in the current situation there is one having a dimension of approximately 22 μm. Incidentally, as the structure of a magnetic element having such a gap, there is one described in Patent document 1.

There also exists a structure such that a tape member made of resin or the like is attached on butting portions of the first core and the second core to thereby obtain a gap having a dimension of the thickness of the tape member between the first core and the second core. In this structure, the tape member exists at the boundary part between the first core and the second core, and the first core and the second core are joined with each other via this tape member.

Furthermore, as another technique to obtain a transformer having an inductance of desired value, the first core and the second core are formed of a material having a relative permeability (μ) of approximately 5000, and the first core and the second core are butted to each other without having a gap therebetween.

[Patent document 1] Japanese Patent Application Laid-open No. 2003-31422 (refer to Abstract, FIG. 1, and FIG. 5 to FIG. 8)

Meanwhile, among the above-described transformers, one combining the materials with a high relative permeability and having a narrow gap has a problem that it is difficult to form the narrow gap. Specifically, when forming a very narrow gap of 22 μm for example, it is difficult to accurately control dimensional precision. Also, when butting the first core to the second core, a butting error or the like occurs. Accordingly, it is difficult to provide the desired narrow gap between the first core and the second core. Further, when forming such a narrow gap with high precision, improvement in the aspect of precision is required, so that the processing cost thereof increases. The requirement to form the narrow gap also causes a problem that the time to produce a transformer becomes long, thereby decreasing production efficiency.

Further, in the structure having the tape member intervening between the first core and the second core, there is a problem that the tape member melts by heating. Specifically, when mounting the transformer on a board, a step accompanying heating such as soldering by reflowing is involved, but in such a heating step, the tape member in a thin film form having a dimension of the thickness of the above-described narrow gap melts easily. When the tape member thus melts, the gap dimension cannot be controlled accurately, and then the desired characteristic cannot be obtained.

Moreover, in the case where the first core and the second core are formed of the material having a relative permeability of approximately 5000, high frequency signals do not attenuate because there is no gap, so that the high frequencies are picked up as noise by a secondary side coil. In other words, when the first core and the second core are composed of the material having a relative permeability of approximately 5000, there is a problem that the characteristic as a band-pass filter is poor and a function thereof is not exhibited.

As described above, in the current situation, it is difficult to form a transformer having a desired characteristic equivalent to that of the transformer having a narrow gap as well as the advantage of high productivity that enables cost reduction.

SUMMARY OF THE INVENTION

The present invention is made in view of the above-described situations, and an object thereof is to provide a magnetic element capable of obtaining a desired characteristic and at the same time having high productivity that enables cost reduction.

In order to achieve the above-described object, one aspect of the present invention includes a first core, a second core which abuts on the first core, and a coil to which a signal is inputted, the coil wound on at least one of the first core and the second core, in which the relative permeability of the first core is set higher than the relative permeability of the second core, and a closed magnetic circuit is formed between the first core and the second core without having a magnetic gap.

In such a structure, the closed magnetic circuit is formed between the first core and the second core without having a magnetic gap. Here, since the relative permeability of the first core is set higher than that of the second core, a desired characteristic can be obtained by the entire magnetic element without providing a magnetic gap between the first core and the second core as in prior arts. Specifically, the first core having the higher relative permeability can attenuate high frequency signals, and the second core having the lower relative permeability can combine effective permeabilities to help attenuation of low frequency signals. Accordingly, it becomes possible to obtain a characteristic equivalent to that of a magnetic element in which a narrow gap exists.

Another aspect of the invention includes a first coil to which a signal is inputted, a second coil to which the signal inputted to the first coil is transmitted, a first core having a first columnar leg portion on which the first coil is wound and a first peripheral wall portion arranged on the periphery of the first columnar leg portion, and a second core having a second columnar leg portion on which the second coil is wound and a second peripheral wall portion arranged on the periphery of the second columnar leg portion, in which the relative permeability of the first core is set higher than the relative permeability of the second core, the first columnar leg portion and the second columnar leg portion abut on each other, and the first peripheral wall portion and the second peripheral wall portion abut on each other.

In such a structure, the first columnar leg portion and the second columnar leg portion, and the first peripheral wall portion and the second peripheral wall portion abut on each other respectively without having a gap therebetween. In this case, by adjusting the relative permeability of the first core and the second core respectively in a state that the relative permeability of the first core is set higher than that of the second core, a desired characteristic can be obtained by the entire magnetic element without providing a gap between the first core and the second core as in prior arts. Specifically, the first core having the higher relative permeability can attenuate high frequency signals, and the second core having the lower relative permeability can attenuate low frequency signals, which makes it possible to obtain as a band-pass filter a characteristic equivalent to that of a magnetic element in which a narrow gap exists.

Also, it is no longer necessary to provide a narrow gap between the first core and the second core in order to obtain the desired characteristic, so that the number of steps is reduced, and the productivity can be improved. Additionally, since the number of steps is reduced, it becomes possible to reduce the production cost. Also, it is no longer necessary to have a tape member intervening between the first core and the second core in order to form a narrow gap therebetween. Accordingly, it is possible to prevent a problem that the tape member melts by heat during mounting such as reflowing, and thus the dimension of the gap cannot be controlled accurately.

In another aspect of the invention, in addition to the above-described aspect of the invention, the relative permeability of the first core is set in the range of 4 times to 100 times with respect to the relative permeability of the second core. With such a structure, the difference in relative permeability between the first core and the second core becomes large, and it becomes possible to obtain a band-pass filter having a characteristic equivalent to those of conventional structures in which a narrow gap exists between high-μ materials.

Furthermore, in another aspect of the invention, in addition to the above-described aspects of the invention, the relative permeability of the first core is in the range of 2000 to 30000, and the relative permeability of the second core is in the range of 20 to 2000. With such a structure, the difference in relative permeability between the first core and the second core can be made large, and it becomes possible to obtain a band-pass filter having the characteristic equivalent to those of the conventional structures in which a narrow gap exists between high-μ materials.

Furthermore, in another aspect of the invention, in addition to the above-described aspects of the invention, the material of the first core is a manganese based magnetic member, and the material of the second core is a nickel based magnetic member. In such a structure, the first core has the higher permeability of the manganese based magnetic member and the second core has the relative permeability of the Ni based magnetic member that is lower than that of the first core. Accordingly, it becomes possible to obtain a band-pass filter having a characteristic equivalent to those of the conventional structures in which a narrow gap exists between high-μ materials.

In another aspect of the invention, in addition to the above-described aspects of the invention, the first core and the second core form symmetrical shapes with a portion to abut on each other being a boundary. In such a structure, the first core and the second core have an area of the same size, which allows their boundary portions to abut on each other without having a step portion, thereby reducing leakage of magnetic flux to the outside. Also, positioning becomes easy when abutting the first core and the second core on each other.

Furthermore, in another aspect of the invention, in addition to the above-described aspects of the invention, the first core and the second core form an EP-type core. With such a structure, a band-pass filter having excellent spatial efficiency can be provided.

In another aspect of the invention, in addition to the above-described aspects of the invention, the magnetic element functions as a band-pass filter which attenuates the amplitude of a signal having a frequency that deviates from a specific band to below a threshold value among signals transmitted from the first coil to the second coil according to a difference in relative permeability between the first core and the second core.

In such a structure, the magnetic element functions as a band-pass filter, so that, among signals inputted to the first coil, a signal in a specific frequency band can be preferably transmitted to the second coil, and meanwhile, a signal having a frequency that deviates from the specific frequency band can be largely attenuated to have an amplitude lower than the threshold value when the signal being inputted to the first coil is transmitted to the second coil.

According to the present invention, with respect to a magnetic element capable of obtaining a desired characteristic, the productivity thereof becomes excellent and the cost thereof can be reduced.

DETAILED DESCRIPTION OF THE PREFERRED EMBODIMENTS

First Embodiment

Figure 1:
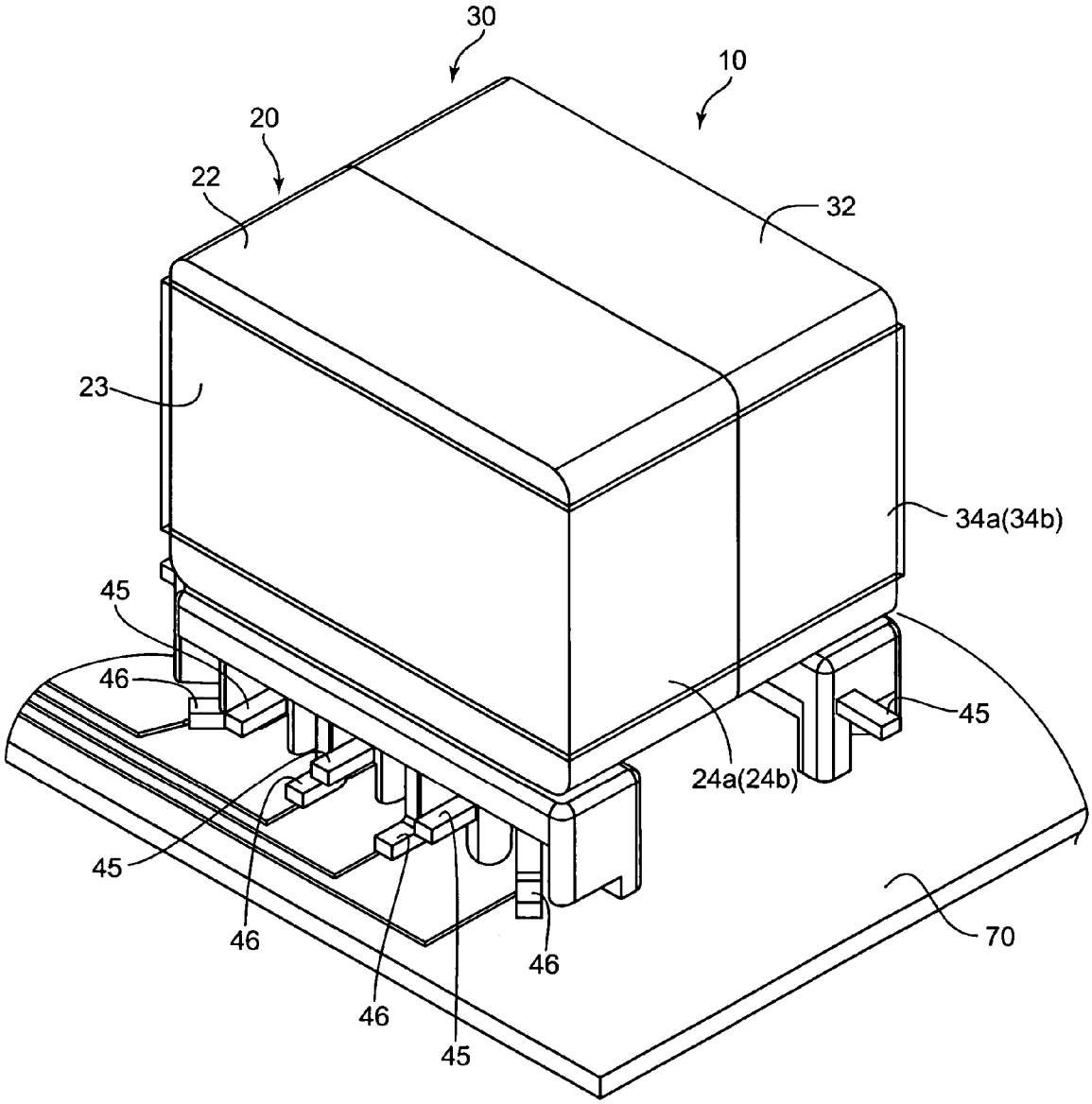
FIG. 1 is a perspective view showing the structure of a transformer according to a first embodiment of the present invention.
Figure 2:
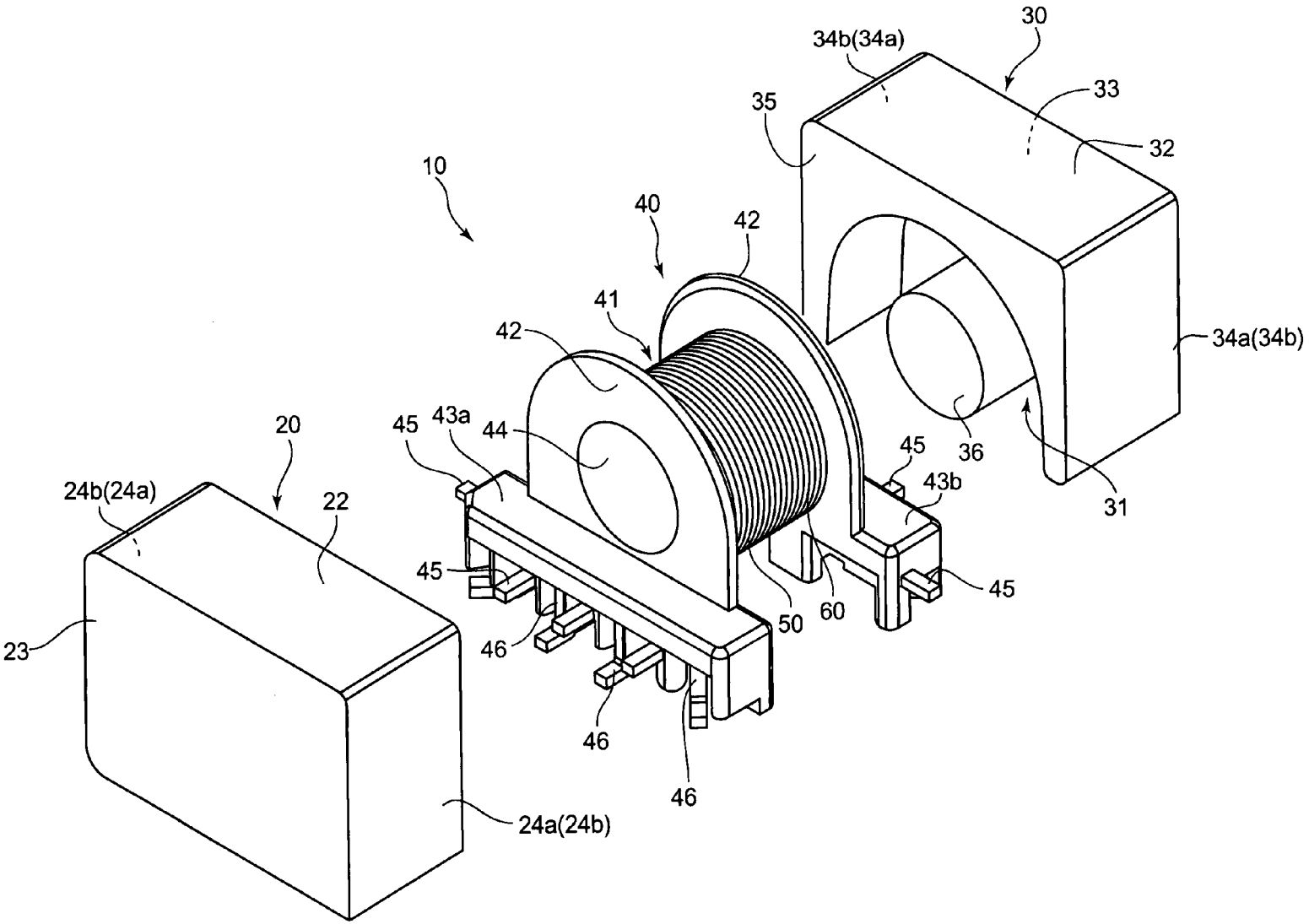
FIG. 2 is an exploded perspective view showing the structure of the transformer in FIG. 1.
Figure 3:
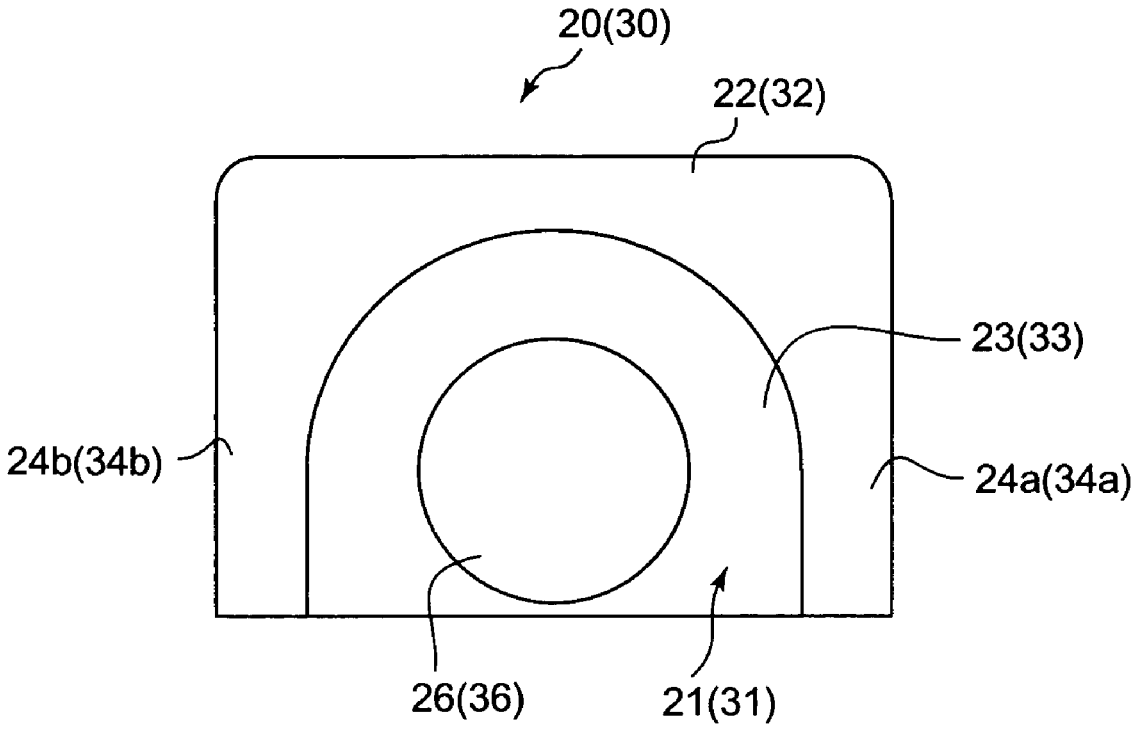
FIG. 3 is a cross-sectional side view showing the structure of the transformer in FIG. 1.
Figure 4:
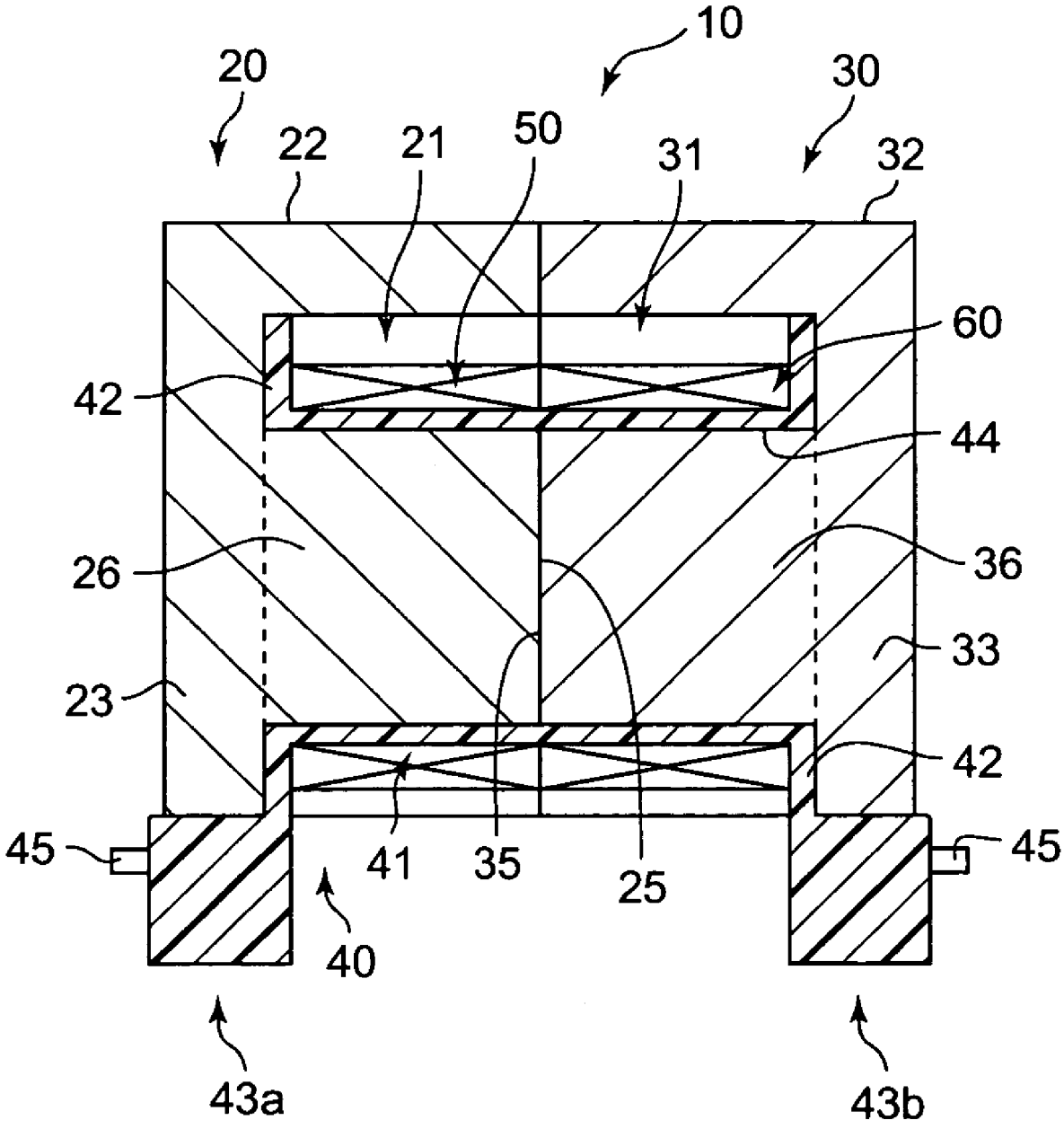
FIG. 4 is a front view showing a shape of a first core or a second core of the transformer in FIG. 1.

Hereinafter, a transformer 10 as a magnetic element according to a first embodiment of the present invention will be described based on FIG. 1 to FIG. 7. FIG. 1 is a perspective view showing the entire structure of the transformer 10. FIG. 2 is an exploded perspective view showing the structure of the transformer 10. Furthermore, FIG. 3 is a front view showing the shape of a first core 20 or second core 30 of the transformer 10. FIG. 4 is a cross-sectional side view showing the internal structure of the transformer 10.

The transformer 10 according to this embodiment includes, as shown in FIG. 2 and FIG. 4, a first core 20, a second core 30, a coil bobbin 40, a primary winding 50, and a secondary winding 60 as main components. Among them, the first core 20 and the second core 30 have symmetrical shapes. Note that the transformer 10 constituted of these members is a magnetic element having a so-called EP-type core.

As shown in FIG. 2 and FIG. 3, the first core 20 is a core member in a box form having openings on two sides, a mounting board plane side and a side to be butted to the second core 30. In this first core 20, a recessed fitting portion 21 is provided. The recessed fitting portion 21 is formed by being surrounded by an upper wall 22 opposite to the mounting board plane side, a side bottom wall 23 opposite to the second core 30, and two peripheral walls 24*a*, 24*b* parallel to the center axis of the first core 20. Note that these upper wall 22, side bottom wall 23 and peripheral walls 24*a*, 24*b* correspond to a first peripheral wall portion.

Note that in the description below, the mounting board plane side (a mounting terminal side which will be described later) of the first core 20 is referred to as a lower side, and the upper wall 22 side thereof is referred to as an upper side. Further, a face of the first core 20 to be butted to the second core 30 is referred to as an opposing face 25.

As shown in FIG. 3 and FIG. 4, the recessed fitting portion 21 is a portion recessed in a reverse U-shape having a predetermined depth. Accordingly, inner wall faces of the peripheral walls 24*a*, 24*b* constituting the recessed fitting portion 21 are substantially in parallel with outer wall faces of the peripheral walls 24*a*, 24*b* from the open lower side toward the upper side, but a front shape of the upper side is in a substantially semi-circle shape. Therefore, portions in the semi-circle shape are formed to be spaced apart from the peripheral walls 24*a*, 24*b* as they rise upward.

In the recessed fitting portion 21, a columnar leg portion 26 (corresponding to a first columnar leg portion) is provided. The columnar leg portion 26 is formed in a cylindrical shape in this embodiment. The columnar leg portion 26 projects from the side bottom wall 23 toward the opposing face 25 side substantially in parallel with an upper end face of the upper wall 22. The projection height of the columnar leg portion 26 is at substantially the same height position as the above-described opposing face 25. Therefore, when the first core 20 and the second core 30 are butted to each other, no gap will be formed between the columnar leg portion 26 and a columnar leg portion 36, which will be described later.

The second core 30 has the same structure as the first core 20. Accordingly, description in detail about the structure is omitted. Note that in the following description, regarding numerals for respective portions of the second core 30, a recessed fitting portion 31, an upper wall 32, a side bottom wall 33, peripheral walls 34*a*, 34*b*, an opposing face 35, and a columnar leg portion 36 (corresponding to a second columnar leg portion) are used. Further, the upper wall 32, the side bottom wall 33, and the peripheral walls 34*a*, 34*b* correspond to a second peripheral wall portion.

Here, the material of the first core 20 is selected to have the higher relative permeability (μ) than the material of the second core 30. In this embodiment, the material of the first core 20 is Mn based ferrite having a relative permeability of approximately 10000. Incidentally, such a material having a relative permeability of approximately 10000 or higher is generally referred to as a high-μ material.

Note that the relative permeability of the first core 20 is not limited to approximately 10000, which may be in the range of 2000 to 30000. However, the relative permeability of the first core 20 is preferred to be approximately 5000 or higher (for example, the case of using an amorphous material or the like), and the relative permeability of the first core 20 being approximately 10000 or higher is much more preferable.

In contrast, the material of the second core 30 is selected to have a lower relative permeability than the material of the first core 20. Here, the relative permeability of the first core 20 is preferred to be set in the range of 4 times to 100 times with respect to the relative permeability of the second core 30.

In this embodiment, the relative permeability of the material of the second core 30 may be in the range of approximately 20 to approximately 2000. A more preferable range of the relative permeability may be approximately 20 to approximately 1000. Furthermore, as will be described later, regarding the relative permeability of the second core 30, experiments are performed with the relative permeability of the first core 20 being set to 10000 and the relative permeability of the second core 30 being set to 100, 400, 850 respectively, and with all of them, a characteristic equivalent to those of conventional transformers in which a narrow gap exists (including transformers in which a narrow gap is formed by a tape member) is obtained. In view of this fact, the characteristic equivalent to those of the conventional transformers can be obtained when the relative permeability is in the range of 100 to 850.

In the case that the relative permeability of the first core 20 is approximately 10000 and the relative permeability of the second core 30 is 850, the characteristic of the transformer 10 corresponds to that of a structure in which a gap of 18 μm exists. An example of the material having a low relative permeability is an Ni based ferrite.

To the columnar leg portions 26, 36, a coil bobbin 40 is attached. The coil bobbin 40 is composed of an insulative material such as resin for example. The coil bobbin 40 has, as shown in FIG. 2, a winding portion 41 on which a primary winding 50 and a secondary winding 60 are wound, flange portions 42 integrally formed with this winding portion 41, and a first terminal block 43*a* and second terminal block 43*b* similarly integrally formed with the winding portion 41.

The winding portion 41 is formed in a substantially cylindrical shape, and on both ends in the axial direction of the substantially cylindrical shape of the winding portion 41, flange portions 42 are provided respectively. In other words, the presence of the flange portions 42 defines winding positions for the primary winding 50 and the secondary winding 60 on the coil bobbin 40. The flange portions 42 each formed to have appearance in a substantially U shape, which corresponds to the shape of appearance of the above-described recessed fitting portion 21. A through hole 44 is provided so as to penetrate the winding portion 41, and the columnar leg portions 26, 36 are inserted into the through hole 44.

On the winding portion 41, conducting wires such as an enameled wire for example are wound respectively. Accordingly, the primary winding 50 (corresponding to a first coil) that is the signal input side is formed on the columnar leg portion 26, and the secondary winding 60 (corresponding to a second coil) that is the signal output side is formed on the columnar leg portion 36. In a state that these primary winding 50 and secondary winding 60 are wound respectively on the winding portion 41, the columnar leg portions 26, 36 are inserted into the through hole 44 of the coil bobbin 40 so that the first core 20 and the second core 30 are butted to each other. After this butting, the first core 20 and the second core 30 are joined with an adhesive or a not-shown pressing member or the like for example.

Incidentally, the primary winding 50 and the secondary winding 60 may be a round wire having a circular cross section, but the primary winding 50 and the secondary winding 60 may also be formed of a conducting wire having a cross section other than that of the round wire, such as a square wire.

On the coil bobbin 40, the first terminal block 43*a* and the second terminal block 43*b* are provided integrally with the flange portions 42. The first terminal block 43*a* and the second terminal block 43*b* are attached respectively to upper portions of the U shapes (in FIG. 4, to lower portions of the flange portions 42 because they are reverse U shape) formed by the flange portions 42, and moreover, in order not to enter the winding portion 41, they project respectively toward non-opposing sides of the flange portions 42 (specifically, the sides in such directions that the first terminal block 43*a* and the second terminal block 43*b* are separated away from each other). The first core 20 and the second core 30 are arranged on the first terminal block 43*a* and the second terminal block 43*b*, respectively.

On the first terminal block 43*a* and the second terminal block 43*b*, plural terminals (binding terminals 45 and mounting terminals 46) are provided. Among them, on the binding terminals 45, one ends or the other ends of the primary winding 50 or the secondary winding 60 wound on the winding portion 41 are bound. For this purpose, height positions of the binding terminals 45 are set higher than height positions of the mounting terminals 46. The mounting terminals 46 are mounted to a circuit board 70.

In this embodiment, two windings, the primary winding 50 and the secondary winding 60 are wound on the winding portion 41. However, windings to be wound on the winding portion 41 is not limited to two, which may be three or more.

Figure 5:
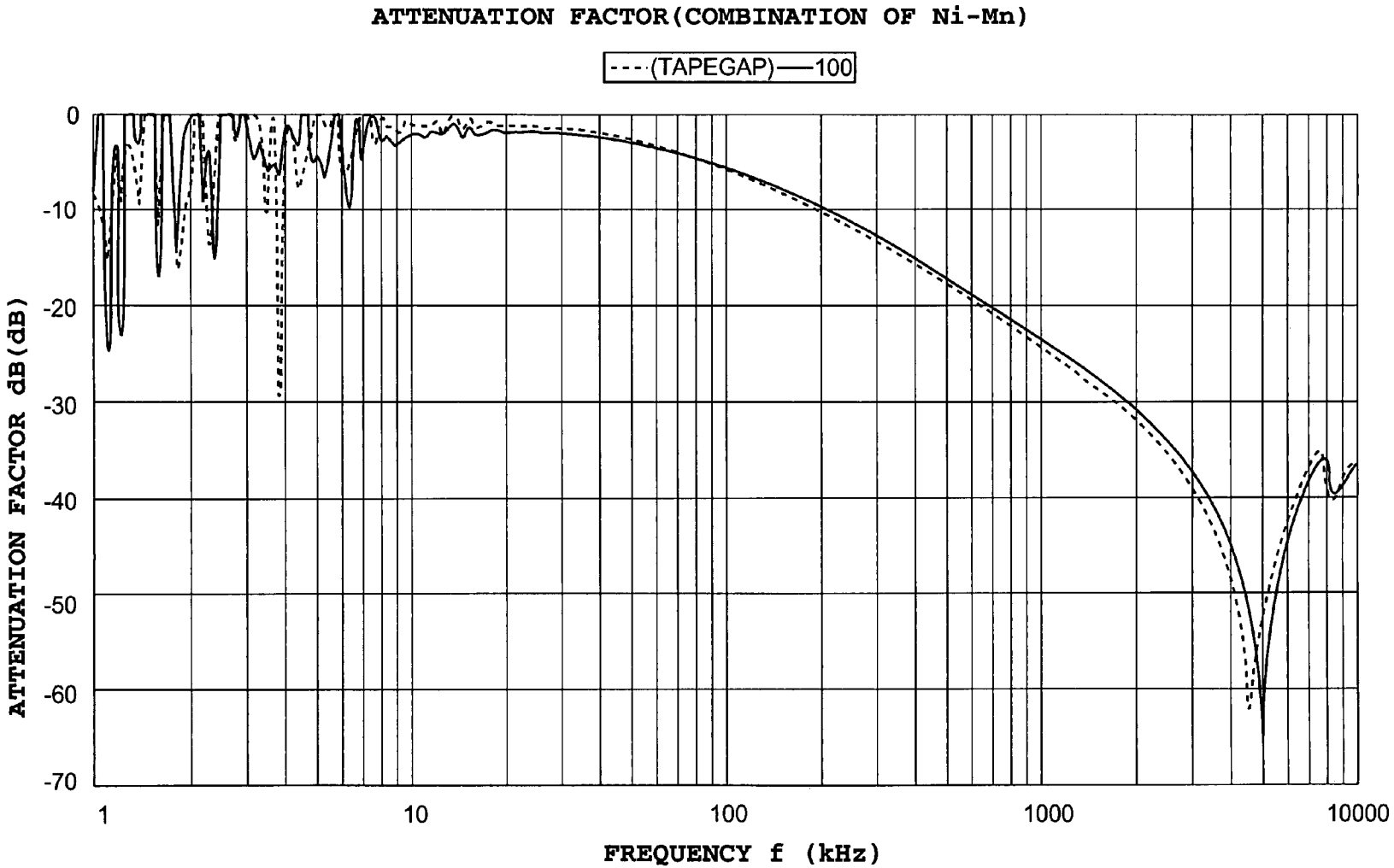
FIG. 5 is a view showing experimental results of the characteristic of the transformer in FIG. 1, a dotted line showing the characteristic of a transformer in which the first core and the second core both have a relative permeability of 10000 and a tape member is sandwiched between both the cores, and a solid line showing the characteristic of a transformer in which the first core has a relative permeability of 10000 and the second core has a relative permeability of 100.
Figure 6:
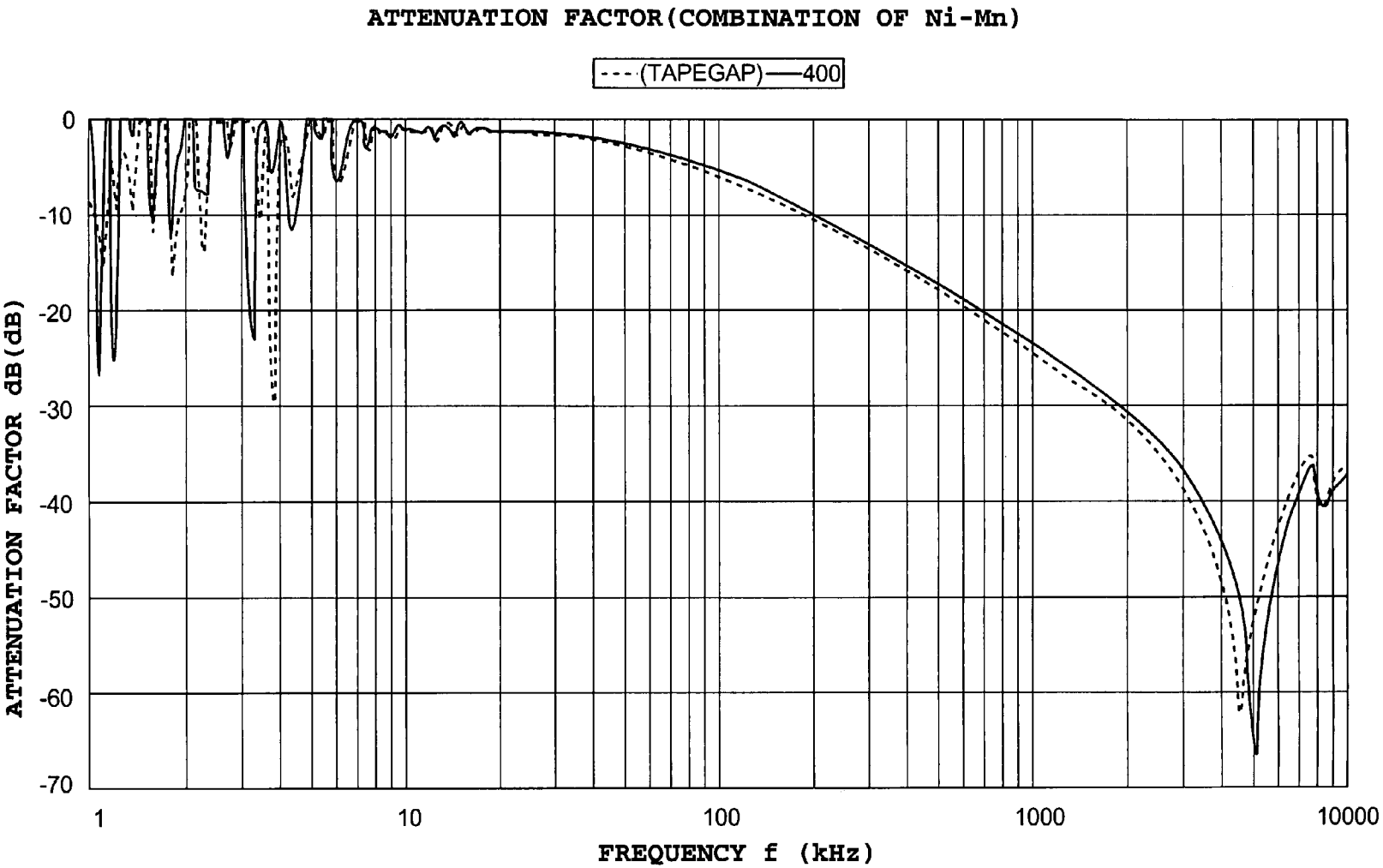
FIG. 6 is a view showing experimental results of the characteristic of the transformer in FIG. 1, a dotted line showing the characteristic of a transformer in which the first core and the second core both have a relative permeability of 10000 and a tape member is sandwiched between both the cores, and a solid line showing the characteristic of a transformer in which the first core has a relative permeability of 10000 and the second core has a relative permeability of 400.
Figure 7:
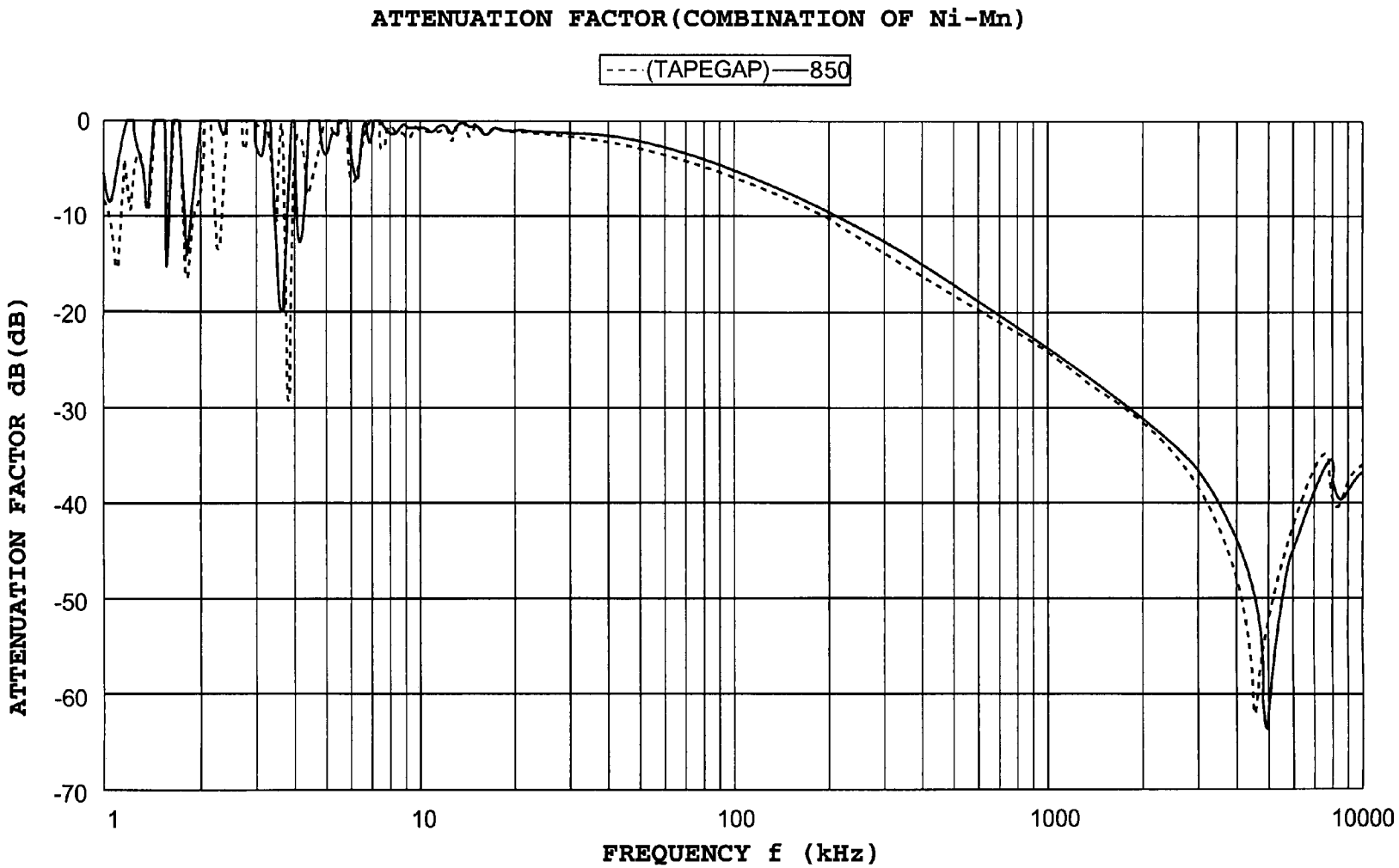
FIG. 7 is a view showing experimental results of the characteristic of the transformer in FIG. 1, a dotted line showing the characteristic of a transformer in which the first core and the second core both have a relative permeability of 10000 and a tape member is sandwiched between both the cores, and a solid line showing the characteristic of a transformer in which the first core has a relative permeability of 10000 and the second core has a relative permeability of 850.

Experimental results of the characteristic of the transformer 10 having the above-described structure are shown in FIG. 5 to FIG. 7. In these FIG. 5 to FIG. 7, the attenuation factor (dB) of the transformer 10 is taken on the vertical axis, and the frequency (Hz) thereof is taken on the horizontal axis. Note that in these experimental results, signals having a frequency ranging from 1 kH to 10 MHz are supplied to the primary winding 50.

In FIG. 5, a dotted line shows the characteristic of a transformer in which the first core 20 and the second core 30 both have a relative permeability of 10000 and a tape member is sandwiched between the first core 20 and the second core 30, and a solid line shows the characteristic of the transformer 10 in which the first core 20 has a relative permeability of 10000 and the second core 30 has a relative permeability of 100.

The characteristic of the transformer 10 shown in FIG. 5 is approximately the same as the characteristic of the transformer in which the tape member is sandwiched. In FIG. 5, the transformer 10 exhibits approximately −3 dB in the vicinity of 50 kHz, and thus it has the characteristic equivalent to that of the conventional transformer. Dispersion occurs on the frequency side lower than 13 kHz, where precise data was not obtained by the measuring apparatus. However, when calculating the mean value of dispersed attenuation factors, it can be seen that in the transformer 10, similarly to the conventional transformer in which the tape member is sandwiched, signals having a frequency on the low frequency side attenuates as the frequency goes low.

Note that a threshold value for the attenuation factor as a high frequency filter can be set diversely. For example, it may be the above-described −3 dB, or may be any other value.

In FIG. 6, a dotted line shows the characteristic of the transformer in which the first core 20 and the second core 30 both have a relative permeability of 10000 and the tape member is sandwiched between the first core 20 and the second core 30, and a solid line shows the characteristic of the transformer 10 in which the first core 20 has a relative permeability of 10000 and the second core 30 has a relative permeability of 400.

The characteristic of the transformer 10 shown in FIG. 6 is also approximately the same as the characteristic of the transformer in which the tape member is sandwiched. The transformer 10 exhibits approximately −3 dB in the vicinity of 50 kHz, and thus it has the characteristic equivalent to that of the conventional transformer. Also in the transformer 10 shown in FIG. 6, dispersion occurs on the frequency side lower than 13 kHz, where precise data was not obtained by the measuring apparatus. However, when calculating the mean value of dispersed attenuation factors, it can be seen that in the transformer 10, similarly to the conventional transformer in which the tape member is sandwiched, signals having a frequency on the low frequency side attenuates as the frequency goes low.

Furthermore, in FIG. 7, a dotted line shows the characteristic of the transformer in which the first core 20 and the second core 30 both have a relative permeability of 10000 and the tape member is sandwiched between the first core 20 and the second core 30, and a solid line shows the characteristic of the transformer 10 in which the first core 20 has a relative permeability of 10000 and the second core 30 has a relative permeability of 850.

The characteristic of the transformer 10 shown in FIG. 7 is also approximately the same as the characteristic of the transformer in which the tape member is sandwiched. The transformer 10 exhibits approximately −3 dB in the vicinity of 50 kHz, and thus it has the characteristic equivalent to that of the conventional transformer. Also in the transformer 10 shown in FIG. 7, dispersion occurs on the frequency side lower than 13 kHz, where precise data was not obtained by the measuring apparatus. However, when calculating the mean value of dispersed attenuation factors, it can be seen that in the transformer 10, similarly to the conventional transformer in which the tape member is sandwiched, signals having a frequency on the low frequency side attenuates as the frequency goes low.

From the above experimental results, when adopting a structure in which the first core 20 is composed of a high-μ material having a high relative permeability, the second core 30 is composed of a material having a low relative permeability, and the both are butted to each other, it is possible to have a characteristic equivalent to that of the structure of a conventional transformer 10 which has the first core 20 and the second core 30 both composed of the high-μ material and the narrow gap between the columnar leg portion 26 and the columnar leg portion 36. Specifically, in view of the average values, the transformer 10 attenuates signals in a low frequency domain.

According to such a structure of the transformer 10, the first core 20 is provided with a higher relative permeability than the second core 30, and the columnar leg portion 26 and the columnar leg portion 36 and the first peripheral portion and the second peripheral portion abut on each other respectively without having a gap therebetween.

In this case, when the respective relative permeabilities are set in a state that the first core 20 is provided with the higher relative permeability than the second core 30, the characteristic (desired characteristic) equivalent to those of the conventional transformers having a narrow gap can be obtained by the entire transformer 10 without providing a gap between the first core 20 and the second core 30. In other words, the presence of the second core 30 having a low relative permeability enables attenuation of low frequency signals.

Since the material having a high relative permeability is used as the first core 20, the transformer 10 can have a high impedance. Furthermore, since the second core 30 have a lower relative permeability than the first core 20, it also enables decrease of loss as compared to structures using a material having a high relative permeability for both the two cores as in prior arts.

It is no longer necessary to provide a narrow gap between the first core 20 and the second core 30 in order to obtain the desired characteristic. Accordingly, required steps for processing the narrow gap can be eliminated, so that the productivity can be increased. Since the processing of the narrow gap is not needed, the cost required for the processing can be suppressed. Particularly, in the current situation, a very narrow gap of approximately 22 μm is formed, so that the effect of increasing productivity and the effect of reducing the cost owing to the elimination of the gap become large.

Furthermore, it is no longer unnecessary to have the tape member between the first core 20 and the second core 30 so as to form a narrow gap as in prior arts. Accordingly, it becomes possible to prevent a problem that the tape member melts by heat during mounting such as reflowing, and thus the dimension of the gap cannot be controlled accurately. Specifically, since the tape member does not intervene, it becomes possible to perform mounting such as reflowing without any problem, and also the need of accurately controlling the dimension of the narrow gap can be eliminated.

In this embodiment, the relative permeability of the first core 20 is set in the range of 4 times to 100 times with respect to the relative permeability of the second core 30. Accordingly, the difference in relative permeability between the first core 20 and the second core 30 becomes large, and it becomes possible to obtain a band-pass filter having the characteristic equivalent to those of conventional structures in which a narrow gap exists between high-μ materials.

In this embodiment, the relative permeability of the first core 20 is in the range of 2000 to 30000, and the relative permeability of the second core 30 is in the range of 20 to 2000. In this case, the difference in relative permeability between the first core 20 and the second core 30 can be made large, and it becomes possible to obtain a band-pass filter having the characteristic equivalent to those of the conventional structures in which a narrow gap exists between high-μ materials.

The material of the first core 20 is an Mn based magnetic member having a high relative permeability of approximately 10000 or the like, and the material of the second core 30 is an Ni based magnetic member having a lower relative permeability compared to the Mn based magnetic material. Accordingly, the difference in relative permeability between the first core 20 and the second core 30 allows as a band-pass filter to have the characteristic equivalent to those of the conventional structures in which a narrow gap exists between high-μ materials.

The first core 20 and the second core 30 form symmetrical shapes with a portion to abut on each other being a boundary. In such a structure, the first core 20 and the second core 30 have an area of the same size, which allows their boundary portions to abut on each other without having a step portion, thereby reducing leakage of magnetic flux to the outside. Also, positioning becomes easy when abutting the first core 20 and the second core 30 on each other.

The first core 20 and the second core 30 forms an EP-type core. This structure enables the primary winding 50 and the secondary winding 60 to function as a band-pass filter having excellent spatial efficiency. Since there is a large difference in relative permeability between the first core 20 and the second core 30 as described above, the transformer 10 can have a function equivalent to those of conventional band-pass filters in which a narrow gap exists.

Since the transformer 10 has the second core 20 having the low relative permeability, its temperature characteristic can be made close to those of the conventional example in which a narrow gap exists and the conventional example in which a tape gap exists.

Second Embodiment

Hereinafter, a transformer 11 as a magnetic element according to a second embodiment of the present invention will be described based on FIG. 8. Note that in this embodiment, the same structures as those in the above-described first embodiment are described with the same reference numerals.

The transformer 11 according to this embodiment is a so-called EE-type transformer and has a first core 200 having a planer shape in an E-form, a second core 300 similarly having a planer shape in an E-form, and a coil bobbin 400. Among them, the first core 200 and the second core 300 have substantially the same shape. Also, the materials of the first core 200 and the second core 300 are the same as those in the first embodiment, and the relative permeabilities of the first core 200 and the second core 300 are the same as those in the first embodiment.

Also in this embodiment, the material of the first core 200 is Mn based ferrite having a relative permeability of approximately 10000 (a high-μ material). The material of the second core 300 is selected to have a lower relative permeability than the material of the first core 200. Here, the relative permeability of the first core 200 is preferred to be set in the range of 4 times to 100 times with respect to the relative permeability of the second core 300. The relative permeability of the material of such a second core 300 may be in the range of approximately 20 to approximately 2000. A more preferable range of the relative permeability may be approximately 20 to approximately 1000.

From the experimental results in FIG. 5 to FIG. 7, a characteristic equivalent to those of the conventional transformers can be obtained when the relative permeability of the first core 200 is 10000 and when the relative permeability of the second core 300 is in the rage of 100 to 850. An example of the material of the second core 300 having the low relative permeability is Ni based ferrite.

Note that the relative permeability of the first core 200 is not limited to approximately 10000, which may be in the range of 2000 to 30000. However, the relative permeability of the first core 200 is preferred to be approximately 5000 or higher (for example, the case using an amorphous material or the like), and the relative permeability of the first core 200 being approximately 10000 or higher is much more preferable.

Here, recessed fitting portions 210, 310 of the first core 200 and the second core 300 in this embodiment are provided in a more open state as compared to the recessed fitting portion 21, 31 in the first embodiment. Specifically, the recessed fitting portions 21, 31 recessing in the reverse U-shape in the first embodiment are provided in a state that among the side walls formed by the peripheral walls 24*a*, 24*b* and the upper walls 22, 32 and so on, the mounting board plane side is open. In contrast, the recessed fitting portions 210, 310 in this embodiment are provided in a state that further the upper walls 22, 32 of the first embodiment are open.

Figure 8:
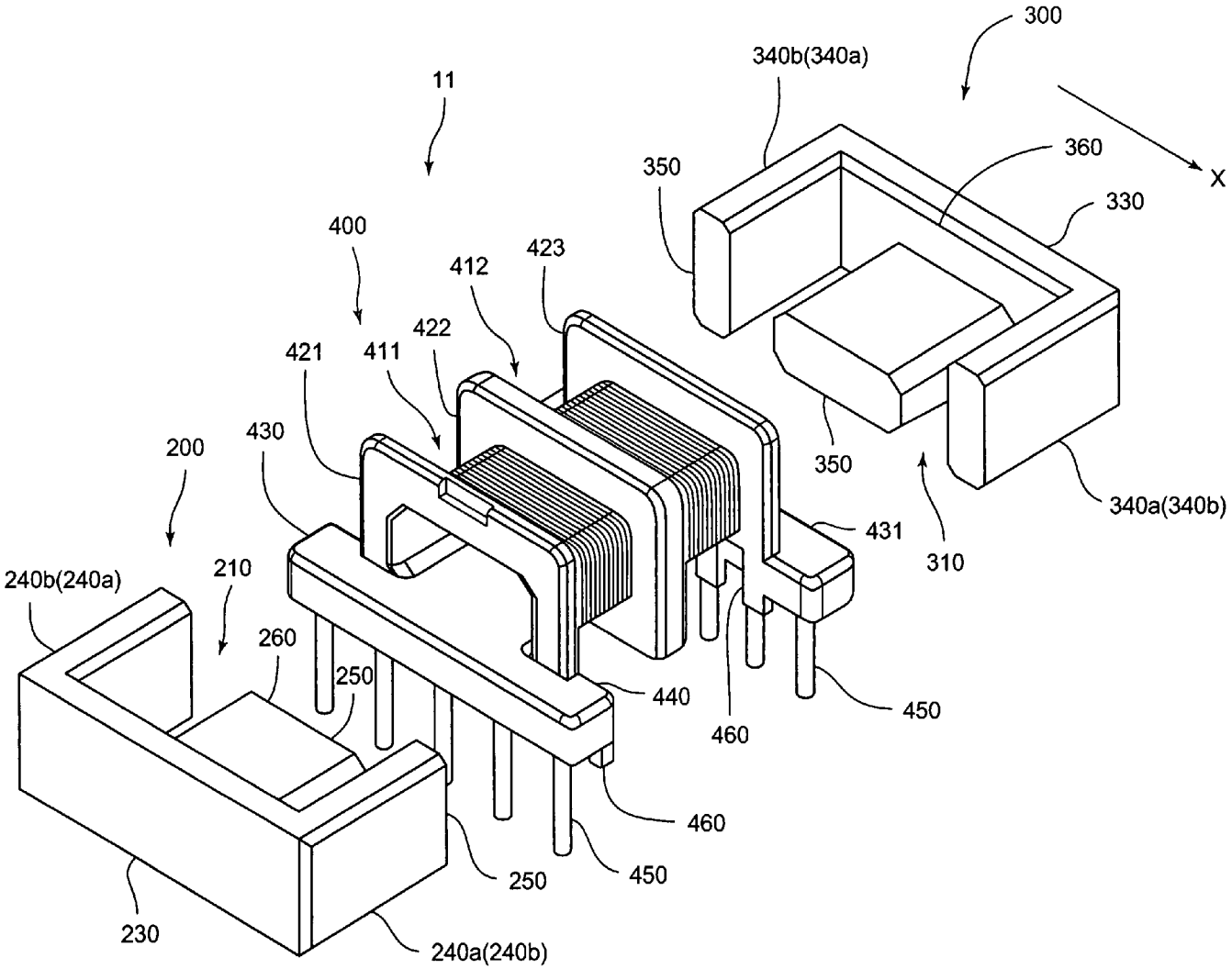
FIG. 8 is an exploded perspective view showing the structure of a transformer according to a second embodiment of the present invention.

Accordingly, the transformer 11 has a structure such that pairs of peripheral walls 240, 340 are arranged on both ends in longitudinal directions (the direction of arrow X in FIG. 8) of the first core 200 and the second core 300, respectively (in FIG. 8, in order to distinguish the pair of peripheral walls 240 and the pair of peripheral walls 340, they are referred to as peripheral walls 240*a*, 240*b* and peripheral walls 340*a*, 340*b* respectively). Also in this embodiment, a columnar leg portion 260 (corresponding to a first columnar leg portion) and a columnar leg portion 360 (corresponding to a second columnar leg portion) are provided in the recessed fitting portions 210, 310, respectively. Note that in this embodiment, the columnar leg portions 260, 360 are formed in a quadrangular column shape extending in a longitudinal direction of the first core 200 and the second core 300. Accordingly, a through hole 440 of the coil bobbin 400 is a hole having a substantially quadrangular shape corresponding to the shape of the columnar leg portions 260, 360. The columnar leg portions 260, 360 project in a state of being substantially parallel with the mounting board.

Note that in this embodiment, a portion corresponding to the side bottom wall 23 of the first core 20 in the first embodiment is a side bottom wall 230. Similarly, a portion corresponding to the side bottom wall 33 of the second core 30 is a side bottom wall 330.

Also in this embodiment, projection heights of the columnar leg portions 260, 360 are at substantially the same height positions as an opposing face 250 of the first core 200 and an opposing face 350 of the second core 300. Therefore, when the first core 200 and the second core 300 are butted to each other, no gap will be formed between the columnar leg portion 260 and the columnar leg portion 360.

The coil bobbin 400 of this embodiment has three flange portions, which is different from a structure having a pair of flange portions 42 like the coil bobbin 40 in the first embodiment. Accordingly, the coil bobbin 400 has not a structure having one winding portion 41 like the coil bobbin 40, but a structure having two winding portions.

Note that in the description below, three flange portions in FIG. 8 are referred to as an upper flange portion 421, a middle flange portion 422, and a lower flange portion 423 in order from the first core 200 toward the second core 300. Also, the two winding portions are referred to as a first winding portion 411 (this is a portion partitioned by the upper flange portion 421 and the middle flange portion 422) and a second winding portion 412 (this is a portion partitioned by the middle flange portion 422 and the lower flange portion 423) in order from the first core 200 to the second core 300.

The coil bobbin 400 in this embodiment also has a first terminal block 430 and a second terminal block 431. Here, from the first terminal block 430 and the second terminal block 431, plural pin terminals 450 (in this embodiment, five pin terminals from each of the first terminal block 430 and the second terminal block 431) projects downward. The pin terminals 450 are parts to be inserted into holes provided on a mounting portion of a board. On the pin terminals 450, ends of a primary winding 50 or a secondary winding 60 are bound respectively. Thus, the pin terminals 450 in this embodiment serve as the binding terminals 45 and the mounting terminals 46 in the first embodiment.

The first terminal block 430 and the second terminal block 431 are each provided with plural projections 460 which project downward from a bottom surface thereof. The projections 460 have a length shorter than the pin terminals 450. Accordingly, when being mounted on the board, the bottom surface of each projection 460 abuts on the board with the pin terminals 450 being inserted into the holes. Thus, the pin terminals 450 are not inserted into the holes up to their bases, which enables prevention of the portions on the pin terminals 450 on which the ends of the primary winding 50 or the secondary winding 60 are bound from colliding with the board. Specifically, the pin terminals 450 secures the portions for binding the ends of the primary winding 50 or the secondary winding 60.

Incidentally, it may be structured such that the pin terminals 450 serve only as the mounting terminals 46 in the first embodiment, and binding terminals which correspond to the binding terminals 45 are provided separately.

When assembling the transformer 11 having such respective portions, the primary winding 50 and the secondary winding 60 are wound on the first winding portion 411 and the second winding portion 412, respectively. The ends of the first and second windings 50, 60 are wound on any of the pin terminals 450, respectively. Then, the columnar leg portions 260, 360 are inserted into a through hole 440. When the first core 200 and the second core 300 are brought into a state of butting to each other (in contact with each other), the opposing faces 250, 350 of the peripheral walls 240, 340 abut on each other, and also the opposing faces 250, 350 of the columnar leg portions 260, 360 abut on each other. This creates no narrow gap between the columnar leg portions 260 and the columnar leg portion 360. At this time, the first core 200 and the second core 300 abut on each other with no magnetic gap (narrow gap) exists, and this abutment forms a closed magnetic circuit.

After this butting, the first core 200 and the second core 300 are joined with an adhesive or a not-shown pressing member or the like for example. Thus, the transformer 11 is assembled.

In the transformer 11 having such a structure, it is possible to produce the operation and effect similar to those of the transformer 10 of the first embodiment. Specifically, the characteristic (desired characteristic) equivalent to those of the conventional transformers having a narrow gap can be obtained by the entire transformer 11 without providing a gap between the first core 200 and the second core 300. The presence of the second core 300 having a low relative permeability enables to combine effective permeabilities, which makes it possible to help attenuation of low frequency signals.

In the transformer 11, the primary winding 50 and the secondary winding 60 wound on the coil bobbin 400 are clearly partitioned by the middle flange portion 422. This facilitates winding of the primary winding 50 and the secondary winding 60, and thus workability when assembling the transformer 11 can be improved.

In the foregoing, the first and second embodiments of the present invention have been described, but other than them, the present invention can be modified in various ways. This will be described below.

In the first embodiment, the case of using the first core 20 and the second core 30 forming an EP-type core as the transformer 10 is described. In the second embodiment, the case of using the first core 200 and the second core 300 forming an EE-type core as the transformer 11 is described. However, the transformers 10, 11 are not limited to the case of using the EP-type core. For example, the present invention can be applied with cores for various signals such as EI-type core, EF-type core, ER-type core, RM-type core, and the like being adopted as the first core and the second core.

In the first embodiment, the columnar leg portion 26 in a cylindrical shape is the first columnar leg portion and similarly the columnar leg portion 36 in a cylindrical shape is the second columnar leg portion. In the second embodiment, the columnar leg portion 260 in a quadrangular column shape is the first columnar leg portion and similarly the columnar leg portion 360 in a quadrangular column shape is the second columnar leg portion. However, the first columnar leg portion and the second columnar leg portion are not necessarily be the cylindrical shape or the quadrangular shape, which may be modified to, for example, an elliptic cylinder shape, triangle pole shape, and the like.

Furthermore, in the respective embodiments, there is described the case of applying the present invention to a magnetic element related to a winding coil on which a conducting wire is wound. However, the magnetic element is not limited to the winding coil, and the present invention may be applied to a layered coil produced by a printing method, a thin film coil produced using vapor deposition/sputtering.

The magnetic element is not limited to the transformer composed of two windings 50, 60, and the present invention may be applied to a transformer having three or more windings. For example, it may be a structure having one primary winding and two secondary windings.

In the respective embodiments, the first core 20, 200 and the second core 30, 300 forming symmetrical shapes are described. However, the first core 20, 200 and the second core 30, 300 may form asymmetrical shapes with respect to each other. When the first core 20, 200 and the second core 30, 300 form symmetrical shapes, there may be adopted a structure having an identifier which facilitates identification of the first core 20, 200 and the second core 30, 300 in a visual or tactile manner.

Furthermore, regarding the transformer 10 as a band-pass filter, the frequency of a signal to be passed is not limited to 13 kHz. As long as it has a difference in relative permeability between the first core 20 and the second core 30 as described above, it may be one that passes any frequency band either in the vicinity of a frequency higher than 13 kHz or in the vicinity of a frequency lower than 13 kHz.

In the respective embodiments, the magnetic elements such as a transistor having two windings (the primary winding 50 and the secondary winding 60) are described. Also, the magnetic element using three or more windings is described in the modification example. However, the magnetic element is not limited to the structure having two or more windings, and a structure having only one winding may be adopted as the magnetic element. In this case, the magnetic element can serve as various inductors, filters, and the like.

The magnetic elements according to the present invention can be used in the field of electric devices.

What is claimed is:

1. A magnetic element, comprising:

a first core made by ferrite;

a second core made by ferrite which abuts on said first core without having a physical gap between the first and second core in the magnetic path formed between the first and second core; and a coil to which a signal is inputted, said coil wound on at least one of said first core and said second core, wherein the relative permeability of said first core is in the range of approximately 10000 and in the range of 10 times more higher than the relative permeability of said second core being 10 to 1000, and a closed magnetic circuit is formed between said first core and said second core.

2. The magnetic element according to claim 1, wherein the material of said first core is a manganese based magnetic member, and the material of said second core is a nickel based magnetic member.

3. The magnetic element according to claim 1, wherein said first core and said second core form symmetrical shapes with a portion to abut on each other being a boundary.

4. The magnetic element according to claim 1, wherein said first core and said second core form an EP-type core.

5. A magnetic element, comprising;

a first coil to which a signal is inputted;

a second coil to which the signal inputted to said first coil is transmitted;

a first core made by ferrite having a first columnar leg portion on which said first coil is wound and a first peripheral wall portion arranged on the periphery of the first columnar leg portion; and a second core made by ferrite having a second columnar leg portion on which said second coil is wound and a second peripheral wall portion arranged on the periphery of the second columnar leg portion, wherein the relative permeability of said first core is in the range of approximately 10000 and in the range of 10 times more than the relative permeability of said second core, and wherein the first columnar leg portion and the second columnar leg portion abut on each other, and the first peripheral wall portion and the second peripheral wall portion abut on each other without having a physical gap between the first and second cores magnetic elements in the magnetic path formed between the first and second columnar leg portion and the second columnar leg portion.

6. The magnetic element according to claim 5, wherein the material of said first core is a manganese based magnetic member, and the material of said second core is a nickel based magnetic member.

7. The magnetic element according to claim 5, wherein said first core and said second core form symmetrical shapes with a portion to abut on each other being a boundary.

8. The magnetic element according to claim 5, wherein said first core and said second core form an EP-type core.

9. The magnetic element according to claim 5, wherein said magnetic element functions as a band-pass filter which attenuates the amplitude of a signal having a frequency that deviates from a specific band to below a threshold value among signals transmitted from said first coil to said second coil according to a difference in relative permeability between said first core and said second core.

* * * * *